US008657710B2

(12) United States Patent
Pona

(10) Patent No.: US 8,657,710 B2
(45) Date of Patent: Feb. 25, 2014

(54) UNIVERSAL HOCKEY PUCK

(76) Inventor: Steven Michael Pona, St. Louis, MO (US)

( * ) Notice: Subject to any disclaimer, the term of this patent is extended or adjusted under 35 U.S.C. 154(b) by 0 days.

(21) Appl. No.: 13/528,384

(22) Filed: Jun. 20, 2012

(65) Prior Publication Data

US 2013/0345001 A1 Dec. 26, 2013

(51) Int. Cl.
*A63B 71/00* (2006.01)

(52) U.S. Cl.
USPC ..... 473/588

(58) Field of Classification Search
USPC ..... 473/588, 589; D21/710
See application file for complete search history.

(56) References Cited

U.S. PATENT DOCUMENTS

| | | | | |
|---|---|---|---|---|
| 2,715,537 | A | 8/1955 | Hofheimer | |
| 2,727,744 | A | 12/1955 | Watson | |
| 3,117,788 | A | 1/1964 | Buonanno et al. | |
| 3,533,626 | A | 10/1970 | Smith | |
| 3,675,928 | A | 7/1972 | Gentile | |
| 3,726,526 | A | 4/1973 | Radovich | |
| 3,784,204 | A | 1/1974 | Felber | |
| D242,372 | S | 11/1976 | Marcucci | |
| 4,111,419 | A | 9/1978 | Pellegrino | |
| 4,326,354 | A | 4/1982 | Hagberg | |
| 4,348,830 | A | 9/1982 | Hagberg | |
| 4,793,769 | A | 12/1988 | Dolan | |
| 4,846,475 | A | 7/1989 | Newcomb et al. | |
| 5,149,096 | A | 9/1992 | Keating et al. | |
| 5,269,520 | A * | 12/1993 | Vellines | 473/588 |
| 5,275,410 | A | 1/1994 | Bellehumeur et al. | |
| 5,288,072 | A | 2/1994 | Hsieh | |
| 5,366,219 | A | 11/1994 | Salcer et al. | |
| D361,610 | S | 8/1995 | Malki | |
| D367,902 | S | 3/1996 | Silk | |
| 5,518,237 | A | 5/1996 | Bellehumeur | |
| 5,564,698 | A | 10/1996 | Honey et al. | |
| 5,597,161 | A | 1/1997 | Bellehumeur et al. | |
| 5,695,420 | A * | 12/1997 | Bellehumeur | 473/588 |
| 5,707,308 | A * | 1/1998 | Liu | 473/588 |
| 5,718,648 | A | 2/1998 | La Savio | |

(Continued)

FOREIGN PATENT DOCUMENTS

DE 19525414 A1 1/1996

OTHER PUBLICATIONS

Prosecution file of U.S. Appl. No. 08/666,091, filed Jun. 19, 1996, 97 pages.

(Continued)

*Primary Examiner* — Raleigh W Chiu
(74) *Attorney, Agent, or Firm* — Senniger Powers LLP

(57) ABSTRACT

A hockey puck for use on both ice and non-ice surfaces. The puck has a plurality of conically shaped apertures extending at an angle from the top to the bottom of the puck to provide a stabilized cushion of air when the puck is in motion. The cushion of air reduces the friction between the puck and the surface, enabling the puck to remain at a high speed for a longer time period. The puck can be manufactured in a standard weight of 6 ounces for regular use or a lighter puck in the range of 4 to 4.25 ounces for junior hockey, street hockey or roller-hockey use. The annular side surface of the puck can be knurled or dimpled to enhance controllability and aerodynamics. Additionally, the corners of the puck can be rounded to reduce the effect of snow-plowing.

11 Claims, 2 Drawing Sheets

(56) References Cited

U.S. PATENT DOCUMENTS

| | | | | |
|---|---|---|---|---|
| 5,733,213 | A | 3/1998 | Colarusso | |
| D394,483 | S | 5/1998 | Dusablon et al. | |
| D396,255 | S | 7/1998 | Kotler | |
| 5,816,965 | A | 10/1998 | Kotler | |
| D401,649 | S | 11/1998 | Bellehumeur | |
| 5,855,528 | A | 1/1999 | Aiello et al. | |
| 5,928,096 | A | 7/1999 | Boardman et al. | |
| 5,976,042 | A | 11/1999 | LaMarche et al. | |
| 6,089,998 | A | 7/2000 | O'Neal et al. | |
| 6,200,238 | B1 * | 3/2001 | Tackett | 473/588 |
| 6,217,468 | B1 | 4/2001 | Goodwin | |
| 6,440,018 | B2 * | 8/2002 | Lekavich | 473/588 |
| RE38,187 | E * | 7/2003 | Bellehumeur et al. | 473/588 |
| 6,592,476 | B1 * | 7/2003 | Bellehumeur et al. | 473/588 |
| D510,967 | S | 10/2005 | Coleman et al. | |
| D510,968 | S | 10/2005 | Coleman et al. | |
| D515,154 | S * | 2/2006 | Coleman et al. | D21/710 |
| 7,104,906 | B2 * | 9/2006 | Coleman et al. | 473/588 |
| 7,276,001 | B2 * | 10/2007 | Coleman et al. | 473/588 |
| 2005/0064967 | A1 | 3/2005 | Coleman et al. | |

OTHER PUBLICATIONS

Product information—SONIC Roller Hockey Puck—http://www.sonicsports.com/products-hockey.html.

Product information—AERO Puck—http://www.verberosports.com/aero.html.

Product information—PRO-SHOT—www.idshockey.com/pucks.html.

Product information—Mission Zero G Puck—http://www.hockeystopohio.com/Inline/puckzerog.htm.

Product information—ProPuck—http://www.propuck.com/hockey_equipment/propuck.html.

Product information—Reebok Speed Puck—http://www.puckstop.comlacatalog/Reebok_Speed_Puck.html.

Product information—D&R Inline Hockey Puck—http://www.puckmart.com/pkm21.html.

* cited by examiner

UNIVERSAL HOCKEY PUCK

FIELD OF THE INVENTION

The present invention generally relates to sporting goods and in particular to hockey pucks for use on ice and non-ice surfaces.

DESCRIPTION OF PRIOR ART

Over the past several decades, the sport of ice hockey has increased in popularity. Originally, ice hockey was a sport limited to colder climate areas. This allowed for outdoor play on frozen ponds and lakes during the winter months. Because of the sport's popularity, many people desired to play hockey regardless of the weather. To achieve this, people used indoor ice rinks, where a suitable layer of ice could be maintained year round. However, ice rinks are expensive to build and maintain and therefore, they exist in limited numbers. In an effort to play more hockey, various forms of street hockey and roller-hockey were established. With street hockey, players use street shoes and no skates. In roller-hockey, in-line roller skates substitute for ice skates and allow a player to skate across a variety of hard surfaces, including concrete and asphalt. In this manner, one could build a rink similar to an indoor-ice-rink, only using concrete, asphalt, wood or some other hard material in lieu of ice, thus reducing the costs associated with maintaining a frozen ice surface. This allowed hockey players to play a version of hockey year-round at reduced costs.

While playing street hockey and roller-hockey, hockey players noted the hard rubber puck used in ice hockey does not adequately slide on the non-ice surface due to the increased friction between the rubber puck and the surface. To compensate for this, several "off-ice" pucks were created, such as those shown in U.S. Pat. No. 5,275,410 issued to Bellehumeur et al., U.S. Pat. No. 5,269,520 issued to Vellines and U.S. Pat. No. 4,793,769 issued to Dolan. Unfortunately, none of these pucks could be used on both ice and non-ice surfaces, nor did they provide acceptable puck control.

The Bellehumeur puck contains a number of runners extending through the puck. These runners are generally made of plastic or wound nylon. During use, only these runners contact the ground and allow the puck to slide across the non-ice surface. The puck is intended to slide in an analogous manner to a standard rubber puck on an ice surface. Because of the runners, however, it is a puck designed exclusively for roller hockey and is neither practical nor acceptable for use in ice hockey. Thus, if a hockey player uses the Bellehumeur puck for roller hockey and a standard rubber puck for ice-hockey, different playing profiles are presented to the user. Further, the runners in the Bellehumeur puck can be safety hazards. When a player strikes the puck, the puck is compressed due to the force of the impact. The compression of the puck has been shown to cause the runners to become dislodged from the puck. When dislodged from the puck, the runners can potentially strike and injure people or become debris on the playing surface which may lodge in a player's skates, causing loss of control and possible injury. In addition, the Bellehumeur puck does not permit adequate control because the side face of the puck is smooth. The smooth face causes slippage between the puck and the hockey stick, decreasing the control a hockey player has on the puck. Further, the Bellehumeur puck is constructed of a composite PVC base material which is not capable of handling temperature extremes. As a result, the puck is not suitable for play in ice-hockey or, during hot days, street hockey and roller hockey.

The Vellines puck comprises a series of discs connected together to form a puck shape. Each disc contains a number of holes extending vertically between opposite faces of the puck. The discs are constructed out of a high density polyethylene which becomes brittle in cold environments, making the puck not suitable for play on normal ice surfaces. Like the Bellehumeur puck, the Vellines puck also has a smooth side face, thereby decreasing the amount of control of the puck by a hockey player.

The Dolan puck takes a regulation hockey puck and inserts a set of ball-bearings to assist the puck in rolling across a non-ice surface. Like the runners of the Bellehumeur puck, the ball-bearings have a tendency to pop out of the puck during play, thereby causing safety hazards. In addition, this puck is not suitable for use on ice and the characteristics of this puck do not match those of a regulation puck sliding across ice.

None of the above patents disclose a puck that could be used effectively on both ice and non-ice surfaces or allow for increased control of the puck by the hockey player. Consequently, there is a need for a puck that will allow increased control and exhibit similar playing characteristics on all surfaces so that hockey players can easily switch from one version of the sport to another without readjusting their game.

SUMMARY

The present invention is directed to a number of improvements in a hockey puck. The hockey puck may be used on a variety of surfaces, which may allow use of the hockey puck as a universal puck for ice hockey, street hockey and roller-hockey. The hockey puck may be intended for use only on a specific surface such as ice or pavement without departing from the scope of the present invention.

A feature of the present invention is a plurality of conically shaped apertures extending at an angle from one puck face to the opposing puck face. These conically shaped apertures channel the air as the puck is in flight so the puck stabilizes on a cushion of air. By stabilizing the puck on a cushion of air, the puck will travel straighter and with less wobble, thereby increasing the accuracy of the shots. Further by traveling on a cushion of air, less friction exists between the puck and the playing surface and, thus, enhances the flow of the puck over both ice and non-ice abrasive surfaces. Although the Bellehumeur puck has areas of open space within the puck, this space is only designed to decrease the weight of the puck without altering the overall puck size. The open spaces in the Bellehumeur puck are not designed to decrease the friction between the puck and a surface by channeling air through the spaces when the puck is traveling across the surface. The holes in the Vellines puck are cylindrical in shape and are primarily designed to reduce the overall weight of the puck. Although some air passes through the holes when the puck is inclined relative to the playing surface (i.e., one of the opposite faces is not parallel to the playing surface), the cylindrical shape of the holes and the vertical positioning of the holes relative to the opposite faces do not allow air to be channeled when the puck is travelling normally (i.e., one of the opposite faces essentially parallel to the playing surface) and therefore the surface friction is not affected.

It is also contemplated that the puck be available in at least two weights. For example, one version of the puck weighs about 6 ounces, the present standard weight for an industry-approved ice hockey puck. The second version of the puck is made the same diameter and width as the 6 ounce puck, yet weighs in the range of 4 to 4.25 ounces. The lighter weight puck is designed for use as a standard roller-hockey puck and can also be used as a junior level ice hockey puck when less weight is desired. Experimentation by the inventor shows that the conical apertures may decrease the strength of vulcanized rubber pucks as used in the prior art and increase the tendency of these pucks to break. Further, the conical apertures may cause vulcanized rubber pucks to break. Further, the conical apertures may cause vulcanized rubber pucks to be too light. Therefore, a stronger, heavier material, either a non-temperature sensitive composite material, or, if desired, a PTFE or Teflon-based material, may be used to achieve the desired weight and strength of a puck with conical apertures. However, other materials may be used without departing from the scope of the present invention, including vulcanized rubber.

In a further embodiment, the hockey puck has rounded corners. The rounded corners allow the puck to efficiently hop over snow, ice, rocks or other debris which may slow the puck's travel.

DETAILED DESCRIPTION

Figure 1:
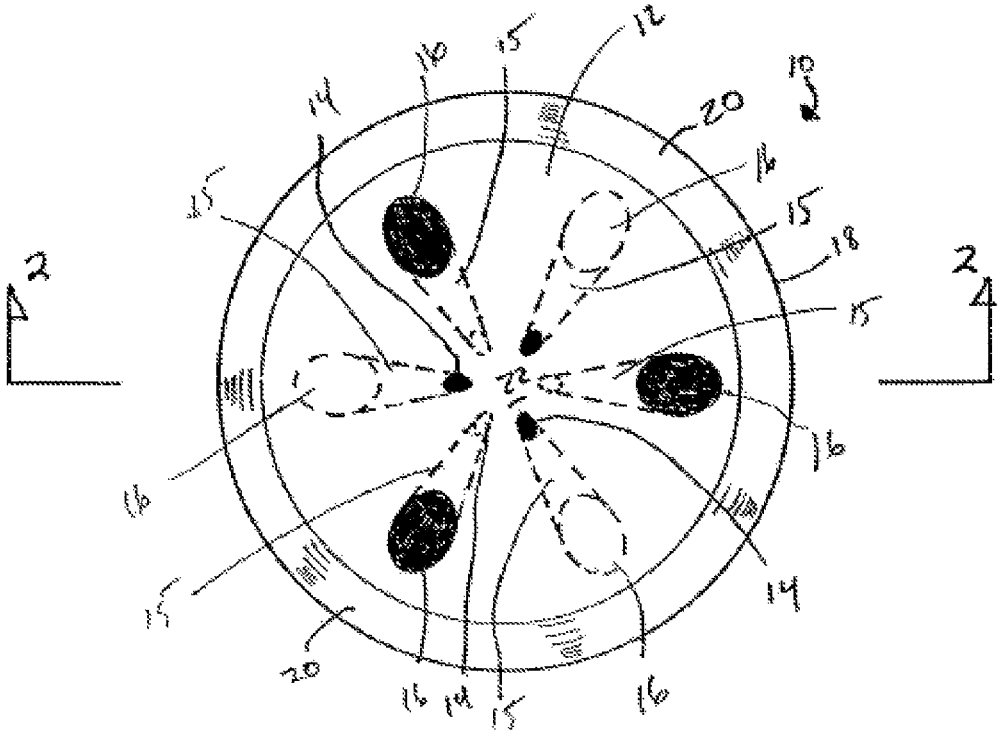
FIG. 1 is a plan view of the puck of a first embodiment of the present invention.
Figure 2:
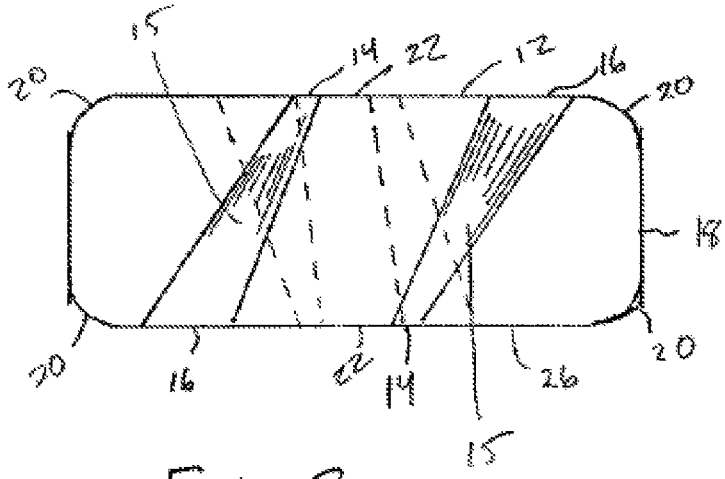
FIG. 2 is a cross-sectional view of the puck in FIG. 1.

Referring to both FIGS. 1 and 2, a puck 10 in accordance with the present invention is shown having a first flat surface 12, a second flat surface 26 and an annular side surface 18. The puck 10 also includes a series of apertures 15. Each aperture 15 is conically shaped and has a large opening 16 at one end and a small opening 14 at an opposite end. Each aperture 15 extends from the one flat surface (either 12 or 26) to the other flat surface (26 or 12, respectively) of the puck 10. It is contemplated that, in the preferred embodiment, there be an even number of apertures with one half of the apertures positioned having their large openings flush with the second flat surface 26. In either case, the apertures are positioned so that the small openings are positioned closer to the center of the flat surfaces than are the large openings. In the preferred embodiment, there are six apertures, as shown in FIG. 1.

It is contemplated that the puck 10 be made from a molded composite or resin material. This allows better sliding on both ice and non-ice surfaces while maintaining the appropriate weight, strength, pliability and sensitivity of the puck 10. If desired, the puck 10 may alternatively be formed with a Teflon-based material or PTFE to enhance sliding. Of course, the puck 10 can be formed from a variety of materials without altering the spirit of the invention. The apertures 15 can be formed in a variety of manners, including injection or compression molding during formation of the puck 10 or can be drilled in after molding the puck 10.

The puck 10 may be manufactured in various weights. In one embodiment, the puck 10 weighs approximately 6 ounces. This weight conforms to the regulation weight of a standard ice hockey puck. Also, to conform to regulation size, the preferred puck 10 measures approximately three inches in diameter and one inch thick. An alternative embodiment of the puck 10 weighs in the range of 4 to 4.25 ounces. This lighter puck design is ideal for use in roller-hockey, street hockey and junior level ice hockey. The lightweight puck design allows children to play hockey using a puck that is proportionate to their height and/or weight. The puck may be a standard size puck, but decreases the risk of injury because it is lighter weight. The lighter weight puck is also easier for children to increase their skill development and fun quotient.

Focusing on FIG. 2, a cut-away view along section line 2-2 of FIG. 1 the apertures 15 are more clearly illustrated. Two apertures 15 are shown in cross-section in the foreground. For each aperture 15, the large openings 16 are located proximate the junction 20 of the flat surfaces (12 or 26) and the annular side surface 18. The apertures 15 extend with decreasing diameters through the puck 10, ending with small openings 14 near the center 22 of the flat surfaces (12 or 26). In the preferred embodiment, the apertures 15 extend through the puck at an approximately 45° angle to permit air to be directed into the apertures during travel. Of course, it can be appreciated that apertures oriented at other angles can be used without departing from the spirit of the invention.

When the puck 10 is in use, a player strikes the puck 10 with a hockey stick, propelling the puck 10 across the surface. As the puck 10 is propelled, air is drawn in through the large openings 16 and directed through the apertures 15, exiting through the small openings 14. According to the Bernouli effect, the pressure of the air will be greater near the small openings 14 where there is a smaller volume for the air to travel through than at the large openings 16. When the air is released to a lower pressure environment (the ambient), the air velocity increases significantly, creating a local jet effect. By creating the combination of an equal number of both large openings 16 and small openings 14 on each of the first flat surface 12 and the second flat surface 26, a uniform cushion of air results around the puck 10 as it travels across the playing surface. The puck 10 stabilizes on this cushion of air, thereby decreasing friction against the playing surface. This allows the puck 10 to travel faster for a longer period of time due to the decrease in friction. The cushion of air is created between the puck 10 and the playing surface, reducing the drag caused by either an ice or non-ice playing surface. Using the same puck 10 on both ice and non-ice surfaces has many advantages. First, a hockey player only needs to carry one type of puck 10 to play ice hockey, street hockey or roller-hockey. Also, the universal puck 10 presents consistent playing characteristics regardless of the playing surface, thereby minimizing the adjustment a hockey player must make when playing on various playing surfaces.

To allow the puck 10 to more easily travel across an abrasive or debris-laden surface, an exaggerated rounded corner is also contemplated. As seen in FIG. 2, junctions 20 are defined by a radius ranging from 1/16 of an inch to 1/8 of an inch. Because this radius results in a more rounded corner than the 1/32 radius on the beveled edge on prior art pucks, the rounded junctions 20 further assist the puck 10 in traveling over debris. When the puck 10 is traveling across a surface, various types of debris may be encountered. These include ice, rocks, sand, puck runners or any other foreign object on the surface. When the puck 10 travels across the playing surface, either the first flat puck surface 26 will be facing the playing surface. Because the puck 10 is symmetrical, the references to the first flat surface 12 and the second flat surface 26 are interchangeable. When the puck 10 of the preferred embodiment hits a piece of debris, the rounded junction 20 closest to the playing surface causes the puck 10 to travel over the debris without interrupting the intended direction or path. As the puck 10 hits the debris, the puck 10 slides on top of the debris, placing puck 10 at a slight angle. The puck 10 momentarily rides at this angle as it travels across the debris, and then eventually settles back flat on the cushion of air. In previous puck designs with either square corners or minimal beveled corners, the puck tends to push debris, adding friction and slowing the puck's travel or causing the puck to roll onto its edge. The rounded junctions 20 allow the puck 10 to travel farther and faster across debris-laden surfaces.

Figure 3:
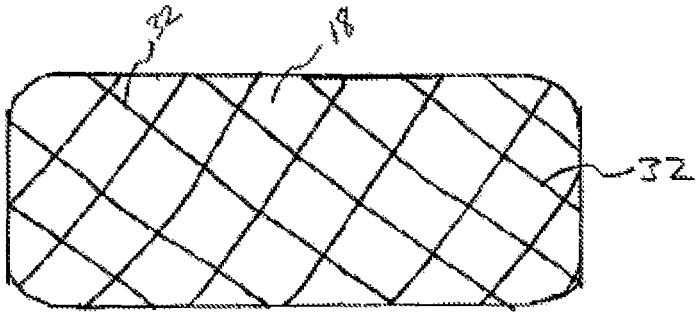
FIG. 3 is a side view of an alternative embodiment of a puck of the present invention having a knurled side.

It is also contemplated that the puck may include a knurled side surface. FIG. 3 shows knurls 32 on the annular side surface 18. Although the knurls 32 are shown in a criss-cross pattern, a variety of patterns may be used without altering the spirit of the invention. When a hockey player handles the puck 10 with a hockey stick, and/or strikes the puck, the knurls 32 increase the friction between the puck 10 and the stick. This increased friction allows a hockey player to maintain greater control of the puck 10. Without the knurls 32, the annular side surface 18 of the puck 10 would be smooth and have a tendency to slip from the hockey stick, increasing the chances of the player mishandling the puck 10. This reduces the need for a player to use excessive amounts of friction tape on the stock blade. The knurls 32 add an appropriate amount of friction to provide proper control.

Figure 4:
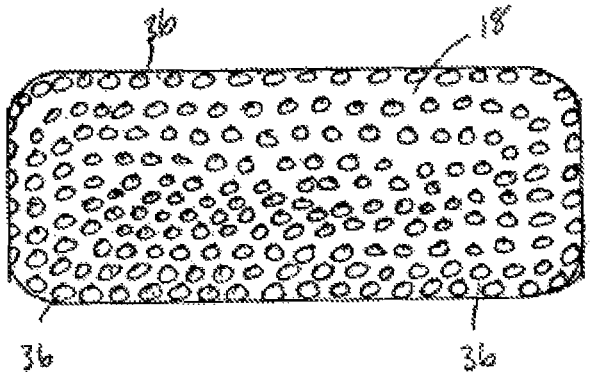
FIG. 4 is a side view of an alternative embodiment of a puck of the present invention having a dimpled side.

In an alternate embodiment the knurls 32 may be replaced by dimples 36, as can be seen in FIG. 4. In this embodiment the entire annular side surface 18 of the puck 10 is covered in concave dimples 36. The dimples 36 are of a similar size and shape and pattern to the dimples used in a golf ball. Like the dimples on a golf ball, the dimples 36 create surface turbulence around the annular side surface 18 of the travelling puck 10. This turbulence decreases drag and increases lift around the puck, allowing the puck 10 to travel straighter and faster. The puck 10 may also be embodied with both knurls 32 and dimples.

Numerous variations and modifications of the puck will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the forgoing description. All changes that come within the meaning and range of equivalency of the claims are to be embraced within their scope.

What is claimed is:

1. A hockey puck adapted for use on a variety of playing surfaces, said puck comprising:

a substantially cylindrical member having a first flat surface, a second flat surface opposing the first flat surface and an annular side surface; and a plurality of conical apertures extending from one of said flat surfaces to the other flat surface to permit the flow of air therethrough, the apertures having a first end with a first diameter and a second end with a second diameter, wherein the first diameter is greater than the second diameter so that the decreasing diameter aperture creates a restriction on the flow of air therethrough resulting in an accelerated velocity of air flow at the outlet of said aperture.

2. The hockey puck of claim 1, wherein the apertures extend from one flat surface to the other flat surface at an acute angle from the flat surfaces.

3. The hockey puck of claim 2, wherein the angle is about 45 degrees.

4. The hockey puck of claim 1, wherein there are an even number of apertures, half of said apertures having the first diameter flush with the first flat surface and half of said apertures having the first diameter flush with the second flat surface.

5. The hockey puck of claim 4, wherein there are six apertures.

6. The hockey puck of claim 1, wherein the puck is made from a molded composite material.

7. The hockey puck of claim 1 wherein the puck is made from a Teflon-based material.

8. The hockey puck of claim 1, wherein the side surface of the cylindrical member is knurled.

9. The hockey puck of claim 1, wherein the side surface of the cylindrical member is dimpled.

10. The hockey puck of claim 1, wherein a first intersection between the first flat surface and the annular side surface of the cylindrical member and a second intersection between the second flat surface and the annular side surface of the cylindrical member are defined by a radius in the range of ⅛ of an inch to 1/16 of an inch.

11. A hockey puck adapted for use on a variety of playing surfaces, said puck comprising:

a substantially cylindrical member having a first flat surface, a second flat surface opposing the first flat surface and an annular side surface; and a plurality of conical apertures extending at an angle through the cylindrical member to permit the flow of air therethrough, each aperture having a first end of a first diameter positioned flush with one of the flat surfaces proximate the annular side surface and a second end of a second diameter positioned flush with the opposing flat surface proximate a center of the cylindrical member, wherein the first diameter is greater than the second diameter so that the decreasing diameter aperture creates a restriction on the flow of air therethrough resulting in an accelerated velocity of air flow, said plurality of apertures symmetrically positioned to define an equal number of large diameter ends flush with each flat surface.

* * * * *